US007563757B2

(12) United States Patent
Kouvroukoglou et al.

(10) Patent No.: US 7,563,757 B2
(45) Date of Patent: Jul. 21, 2009

(54) WATER-SOLUBLE, LIQUID-CONTAINING POUCH

(75) Inventors: Stylianos Kouvroukoglou, Kraainem (BE); Liesbet Maria Cornelia De Troch, Strombeck-Bever (BE); Mark William Ridyard, Woluwe St Pierre (BE)

(73) Assignee: The Procter & Gamble Company, Cincinnati, OH (US)

( * ) Notice: Subject to any disclaimer, the term of this patent is extended or adjusted under 35 U.S.C. 154(b) by 528 days.

(21) Appl. No.: 11/264,242

(22) Filed: Nov. 1, 2005

(65) Prior Publication Data

US 2006/0276364 A1 Dec. 7, 2006

(30) Foreign Application Priority Data

Nov. 22, 2004 (EP) ..... 04447256
Jun. 1, 2005 (EP) ..... 05076278

(51) Int. Cl.
*C11D 17/04* (2006.01)

(52) U.S. Cl. ..... 510/296; 510/406; 510/439

(58) Field of Classification Search ..... 510/296, 510/406, 439

See application file for complete search history.

(56) References Cited

U.S. PATENT DOCUMENTS

| | | | | |
|---|---|---|---|---|
| 4,610,799 | A * | 9/1986 | Wilsberg et al. | 510/296 |
| 6,057,278 | A * | 5/2000 | Gosselink et al. | 510/400 |
| 6,451,750 | B2 * | 9/2002 | Hewitt et al. | 510/297 |
| 6,479,448 | B2 * | 11/2002 | Cropper et al. | 510/296 |
| 6,573,227 | B1 | 6/2003 | Mondin | |
| 6,632,785 | B2 * | 10/2003 | Pfeiffer et al. | 510/439 |
| 6,670,314 | B2 * | 12/2003 | Smith et al. | 510/220 |
| 7,074,748 | B2 * | 7/2006 | Becks et al. | 510/296 |
| 2003/0017955 | A1 * | 1/2003 | Forth et al. | 510/296 |
| 2003/0199414 | A1 * | 10/2003 | Boutique et al. | 510/296 |

FOREIGN PATENT DOCUMENTS

| | | | |
|---|---|---|---|
| DE | 102 46 713 | A1 | 4/2004 |
| EP | 1 400 460 | A1 | 3/2004 |
| WO | WO 02/12432 | A1 | 2/2002 |
| WO | WO 02/057402 | A1 | 7/2002 |
| WO | WO 03/054121 | A2 | 7/2003 |

* cited by examiner

*Primary Examiner*—Lorna M Douyon
(74) *Attorney, Agent, or Firm*—Julie A. McConihay; Armina E. Matthews; Kim William Zerby

(57) ABSTRACT

The present invention relates to water-soluble pouch which contains a liquid detergent composition, wherein the pouch is a water-soluble film, the film material comprising a polyvinyl alcohol, and wherein the liquid detergent composition also comprises a plasticizer, wherein the plasticizer is selected from the group consisting of glycerol, ethylene glycol, diethylene glycol, triethylene glycol, 2-methyl-1,3-propane diol, sorbitol, methanol, diglycerol, 1,4-butane diol, urea and mixtures thereof, and wherein the liquid detergent composition further comprises a viscosity modifier, preferably a hydrogenated castor oil.

3 Claims, No Drawings

WATER-SOLUBLE, LIQUID-CONTAINING POUCH

The present invention relates to water-soluble pouches which contain liquid detergent composition.

BACKGROUND OF THE INVENTION

Liquid-filled pouches are known as a convenient form of packaging consumer products as well as agrochemical and industrial products. The liquid can be provided in pre-measured quantities intended for use as "unit doses". The film enveloping the liquid product, which forms the wall of the pouch, may optionally be soluble in water. A particularly suitable water-soluble film for this purpose is made from polyvinyl alcohol, and, in this context, this invention is particularly suited to packaging unit doses of liquid detergent.

One of the key problems encountered by consumers of these products is that they often handle the pouches with wet hands, or they inadvertently splash some water droplets onto the pouch. If this happens the water droplets can locally dissolve the PVA film thus creating a hole from which the liquid detergent can leak out. This invention greatly reduces or eliminates this problem by specific redesign of the liquid detergent composition.

WO-A-02/12432, published on 14 Feb. 2002, discloses liquid unit dose compositions. It is suggested that preferred compositions comprise, in addition to water, a plasticizer for the pouch material (i.e. the water-soluble film). Such plasticizers can have the dual purpose of being a solvent for the ingredients of the composition and a plasticizer for the pouch material.

However the prior art in general neither mentions nor addresses the technical problem of pouch handling with wet hands.

SUMMARY OF THE INVENTION

The present invention relates to a water-soluble pouch which contains a liquid detergent composition, wherein the pouch is a water-soluble film, the film material comprising a polyvinyl alcohol, and wherein the liquid detergent composition also comprises a plasticizer for the film material, wherein the plasticizer is selected from the group consisting of glycerol, ethylene glycol, diethylene glycol, triethylene glycol, 2-methyl-1,3-propane diol, sorbitol, methanol, diglycerol, 1,4-butane diol, urea, and mixtures thererof, and wherein the liquid detergent composition further comprises a viscosity modifier.

DETAILED DESCRIPTION OF THE INVENTION

The water-soluble film material which encloses the liquid detergent composition comprises polyvinyl alcohol and a plasticiser for the water-soluble pouch material which is selected from the group consisting of glycerol, ethylene glycol, diethylene glycol, triethylene glycol, 2-methyl-1,3-propane diol, sorbitol, methanol, diglycerol, 1,4-butane diol, urea, and mixtures thereof, preferably glycerol. In the present invention such plasticisers can have the dual purpose of being a solvent for the other ingredients of the composition and a plasticiser for the pouch material.

The liquid composition can made by any method and can have any viscosity, typically depending on its ingredients. The viscosity is controlled by using various viscosity modifiers such as hydrogenated castor oil and/or solvents. Hydrogenated castor oil is commercially available as Thixcin®.

Preferably the viscosity modifier imparts non-Newtonian, shear-thinning rheology to the liquid detergent composition.

Other suitable other viscosity modifiers which can be used may be selected from the group consisting of solid triglycerides, fine solids (such as clays, zeolites, silicas, waxes), gums (such as guar gum, xanthan gum, carrageen, gum, Arabica), polysaccharides (such as cellulose or its derivatives, starch or its derivatives, dextrin, pectin), synthetic polymers including polycarboxylates (such as polyacrylates/maleates, polyamines, polyamides, vinyl-polymers and other homo-or co-polymers), and mixtures thereof.

Preferably the viscosity at 21° C. and at low shear, $0.5s^{-1}$, is greater than 3000 centipoise, preferably greater than 5000 centipoise.

The water-soluble film material which encloses the liquid detergent composition comprises polyvinyl alcohol.

Most preferred material for making the water-soluble pouch comprises water-soluble polyvinyl alcohol (including co-polymers thereof), preferably wherein the polymer present in the film is from 60 to 100%, more preferably 80% to 98%, and most preferably 80% to 95% hydrolysed, to improve the dissolution of the material.

Suitable co-polymers include carboxylates, sulphonates and ethoxylates. Itaconic acid acrylic acid, methacrylic acid are examples of suitable carboxylic acid, 2-acrylamido-2-methyl-1-propane sulphonic acid (AMPS) is an example of a preferred sulphonic acid.

The water-soluble film herein may comprise other additive ingredients than the polymer or polymer material. For example, it may be beneficial to add plasticisers, for example glycerol, ethylene glycol, diethyleneglycol, propylene glycol, propane diol, sorbitol and mixtures thereof, additional water, disintegrating aids, fillers, anti-foaming agents, emulsifying/dispersing agents, and/or antiblocking agents. It may be useful that the pouch or water-soluble film itself comprises a detergent additive to be delivered to the wash water, for example organic polymeric soil release agents, dispersants, dye transfer inhibitors. Optionally the surface of the film of the pouch may be dusted with fine powder to reduce the coefficient of friction. Sodium aluminosilicate, silica, talc and amylose are examples of suitable fine powders.

Highly preferred are polyvinyl alcohol films formed by extrusion, blow-extrusion, blow-molding, extrusion casting or solution casting into a thin film. Such a film is preferably 10 to 200 micrometers thick, more preferably from 40 to 100 micrometers thick. A particularly suitable commercially available film is MonoSol 8630®.

Preferred Ingredients of the Liquid Composition

The liquid composition preferably has a density of 0.8 kg/l to 1.3 kg/l, preferably about 1.0 to 1.1 kg/l.

The liquid compositions of the present invention are concentrated and contain relatively low levels of water. The liquid compositions comprise less than 25% by weight water, and preferably between 5-15% by weight water. However, suitable compositions may even comprise less than 5% by weight water.

The liquid of the present invention preferably has a pH of less than 9, preferably less than 8, when measured by dissolving the liquid to a level of 1% in an aqueous medium.

The preferred amounts of ingredients described herein are % by weight of the composition herein as a whole.

If the liquid composition is a detergent composition, it is preferred that at least a surfactant and builder are present, preferably at least anionic surfactant and preferably also non-ionic surfactant, and preferably at least a builder, more preferably at least a water-soluble builder such as phosphate builder and/or fatty acid builder. Other preferred components are enzymes and/or bleaching agents, such as a preformed peroxyacid.

Specific examples of anionic surfactants, nonionic alkoxylated surfactants, cationic surfactants, builder compounds, perfumes, fabric softening clays, cationic fabric softening agents, bleaching agents, suds suppressing systems, and enzymes suitable for use herein are disclosed in WO02/12432, published on 14$^{th}$ Feb. 2002, which is incorporated herein by reference.

Highly preferred are also perfume, brightener, buffering agents (to maintain the pH preferably from 5.5 to 9, more preferably 6 to 8, most preferably about 7.5).

In fabric enhancing compositions, preferably at least a perfume and a fabric benefit agent are present for example a cationic softening agent, or clay softening agent, anti-wrinkling agent, fabric substantive dye.

According to the present invention the composition comprises a plasticiser for the water-soluble pouch material, for example one of the plasticisers described above, most preferably glycerol. Such plasticisers can have the dual purpose of being a solvent for the other ingredients of the composition and a plasticiser for the pouch material.

The compositions may also comprise additional solvents, such as alcohols, diols, monoamine derivatives, glycols, polyalkylane glycols, such as polyethylene glycol, propane diol, monoethanolamine. Highly preferred are mixtures of solvents, such as mixtures of alcohols, and mixtures of diols and alcohols. Highly preferred may be that (at least) an alcohol, diol, monoamine derivative are present. The compositions of the invention are preferably concentrated liquids having preferably less than 50% or even less than 40% by weight of solvent (other than water), preferably less than 30% or even less than 20%. Preferably the solvent is present at a level of at least 5% or even at least 10% or even at least 15% by weight of the composition.

Optionally the compositions may also comprise polyamines and/or polyimines such as those disclosed in WO02/12432. Particularly preferred zwitterionic polyamines are:

(1)

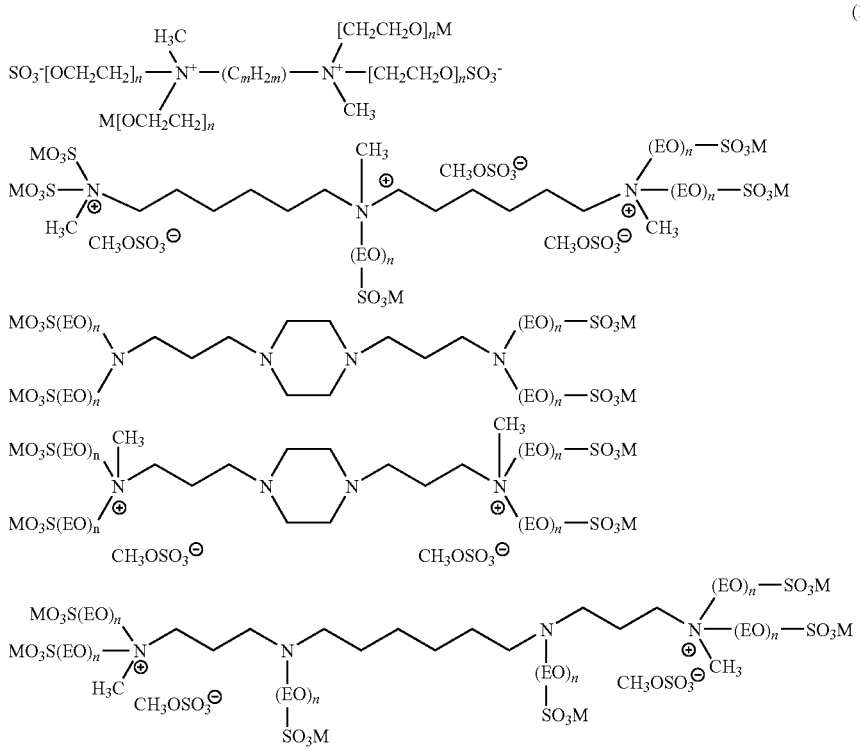

wherein

EO is —$CH_2$—$CH_2$—O—

M is H, Na, K or ammonium m is 2 to 30, preferably 3 to 10, more preferably 6; and n is 15-25.

The weight average molecular weight Mw of the zwitterionic polypolyamines is up to 9,000, preferably from 1,500 to 7,500, and more preferably from 2,000 to 6,000. The zwitterionic polyamines can be soluble or dispersible in water and aqueous or nonaqueous solvents or formulations. In one preferred embodiment of the present invention they are water-soluble. These water soluble zwitterionic polyetherpolyamines are used in laundry detergent compositions and have an excellent degree of clay soil removal from fabrics.

Preferably the ratio of the average number of anionic charges to the average number of cationic charges resulting from protonated or quaternized amine groups is from 0.7 to 1.3.

A particularly preferred water-soluble pouch according to the present invention, contains a liquid detergent composition comprising:

from 1% to 20% by weight of the plasticizer, preferably glycerol;

from 0.01% to 5% by weight of the viscosity modifier, preferably hydrogenated castor oil;

from 10% to 80% by weight of surfactant;

less than 25%, preferably from 5% to 15% by weight of water; and optionally from 0.1% to 6% by weight of zwitterionic polyamine.

EXAMPLES

The following examples will further illustrate the present invention. The compositions are made by combining the listed ingredients in the listed proportions (weight % unless otherwise specified). Example compositions 1 to 5 exemplify compositions according to the present invention but are not necessarily used to limit or otherwise define the scope of the present invention.

All of the exemplified liquid compositions are packed into film pouches, each pouch containing about 50 ml of liquid. The film used to make the pouches is commercially available film, MonoSol 8630®.

| | % by weight | | | |
|---|---|---|---|---|
| | 1 | 2 | 3 | 4 |
| Dodecylbenzene sulphonic acid | 20 | 26 | 23 | 18 |
| C12-14 alcohol, 7x ethoxylated | 22 | 17 | 16 | 24 |
| C12-18 alkyl fatty acid | 16 | 12 | 20 | 22 |
| Citric acid | 1 | 2.0 | — | — |
| Hydroxyethane diphosphonic acid | — | 0.7 | 1.0 | — |
| Diethylene triamine penta methylene phosphonic acid | 0.5 | — | 0.2 | 1.5 |
| Protease/amylase enzymes | 1.5 | 1.0 | 0.7 | 1.2 |
| Polyethyleneimine, 20x ethoxylated | 1 | — | 0.5 | — |
| Zwitterionic polyamine[1] | 2.5 | 3.5 | 2.0 | 2.0 |
| Optical brightener[2] | 0.2 | 0.1 | — | 0.3 |
| Propylene glycol | 5 | 7 | 5 | 5 |
| Plasticizer: | | | | |
| Glycerol | 10 | 8 | 13 | — |
| Ethylene glycol | — | — | | 12 |
| Monoethanolamine | 9 | 10 | 10 | 9 |
| Rheology modifier: Hydrogenated castor oil | 0.2 | — | — | 0.4 |
| Organo-modified clay (Bentone SD3) | — | 1.0 | — | — |
| Diamide wax mixture (Thixatrol Plus) | — | — | 0.5 | — |
| Potassium sulfite | 0.15 | 0.1 | — | — |
| Perfume | 1.5 | 1.0 | 0.8 | 1.3 |
| Water | | To balance | | |

[1]The zwitterionic polyamine is a trans-sulphated ethoxylated hexamethylenediamine quat:

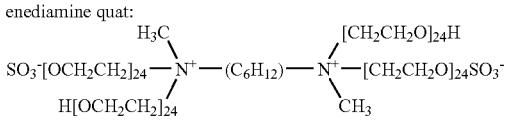

[2]The optical brightener is disodium 4,4'-bis-(2-sulphostyryl)biphenyl, commercially available as Tinopal CBS ®

Example 5 is another example of the invention. Examples A, B, and C are comparative examples.

| | % by weight | | | |
|---|---|---|---|---|
| | 5 | A | B | C |
| Dodecylbenzene sulphonic acid | 23 | 23 | 23 | 23.7 |
| C12-C14 alcohol, 7x ethoxylated | 19.5 | 19.5 | 19.5 | 19.6 |
| C0-C10 amido propyl dimethylamine | — | 1.8 | 1.8 | — |
| C12-18 alkyl fatty acid | 17.3 | 17.3 | 17.3 | 17.3 |
| Citric acid | 0.77 | — | — | — |
| Diethylene triamine penta methylene phosphonic acid | 0.46 | — | — | — |
| Protease/amylase enzymes | 1.4 | 1.3 | 1.3 | 1.2 |
| Polyethyleneimine, 20x ethoxylated | 1 | 1.6 | 1.6 | 1.6 |
| Ethoxylated tetraethylene pentamine | — | 1.6 | 1.6 | 1.6 |
| Zwitterionic polyamine[1] | 2.5 | — | — | — |
| Optical brightener[2] | 0.2 | 0.28 | 0.28 | 0.28 |
| Propylene glycol | 4.7 | 21.9 | 11.9 | 17.5 |
| Plasticizer: Glycerol | 10 | — | 10 | — |
| Monoethanolamine | 9.3 | 8.3 | 8.3 | 8.5 |
| Rheology modifier: Hydrogenated castor oil | 0.2 | — | — | 0.2 |
| Potassium sulfite | 0.15 | — | — | — |
| Perfume | 1.5 | 1.7 | 1.7 | 1.4 |
| Water/minors | | To balance | | |
| Viscosity* at 0.5 $s^{-1}$, 21° C. | 12000 | 330 | 900 | 10000 |
| Viscosity* at 20 $s^{-1}$, 21° C. | 1000 | 330 | 900 | 700 |

*Viscosity measured in centipoises (or $mNs/m^2$)

Description of Test Methodology

To assess the pouch resistance to wet hands leakage a test method has been developed that measures the direct leakage due to water droplets ("Pouch Water Droplet Resistance Measurement"). Leakage is due to the formation of a hole in the film through PVA film dissolution in the water droplet.

The pouch resistance to "leakage due to water droplets" is defined by the percentage of leaking pouches versus non-leaking pouches. All the tests should be done in a temperature and humidity controlled room (21° C., 40% RH) and least 10 pouches are required for a representative measurement. In the case that the water soluble pouch is made from 2 different films (e.g. different thickness) or because one part of the pouch has been stretched due to the vacuum formation the pouch, it is important to assess the resistance to leakage on the same side of the pouch for all replicates. (If aged pouches are tested it is important to record the air bubble position upon pouch aging).

Add 2 μl of water in the middle of the pouch with an eppendorf pipette. Water used is Contrex® water which is 10 times diluted with demineralized water and which has been conditioned at 21° C. After a contact time of 10 minutes, check whether the pouches are leaking by gently lifting them from the test bench. Count the number of pouches leaking and calculate and report the percentage of leakers.

Experiment: Effect of Glycerol Level and Hydrogenated Caster Oil Level on the Pouch Resistance to Wet Hands Leakage.

The liquid compositions 5, A, B, and C are packed into film pouches, each pouch containing about 50 ml of liquid. The film used to make the pouches is commercially available film, MonoSol 8630® (Film is used at thickness of 76 μm and 38 μm). The resistance to wet hands leakage has been assessed via the "Pouch Water Droplet Resistance Measurement" as described herein above.

Results are presented in table below:

| | Hydrogenated castor oil level | | | | | |
|---|---|---|---|---|---|---|
| | 0% | | | 0.2% | | |
| Glycerol level | % leakers | Comp. | Film thickness | % leakers | Comp. | Film thickness |
| 0% | 100% | A | 38 μm | — | — | — |
| | 100% | A | 76 μm | 70% | C | 76 μm |
| 10% | 80% | B | 38 μm | 10% | 5 | 38 μm |
| | — | — | — | 10% | 5 | 76 μm |

The above results clearly show the improved resistance to wet hands leakage of a liquid pouch composition according to the present invention (pouched composition 5), versus comparative pouched compositions (pouched compositions A, B and C). This is demonstrated to be independent of whether the film is thick (76 μm) or thin (38 μm).

All documents cited in the Detailed Description of the Invention are, in relevant part, incorporated herein by reference; the citation of any document is not to be construed as an admission that it is prior art with respect to the present invention. To the extent that any meaning or definition of the term in a document incorporated by reference, the meaning or definition assigned to the term in this written document shall govern.

While particular embodiments of the present invention have been illustrated and described, it would be obvious to those skilled in the art that various other changes and modifications can be made without departing from the spirit and scope of the invention.

It is therefore intended to cover in the appended claims all such changes and modifications that are within the scope of this invention.

What is claimed is:

1. A water-soluble pouch which contains a liquid detergent composition, wherein the pouch is a water-soluble film material, the film material comprising a polyvinyl alcohol, and wherein the liquid detergent composition comprises:

from about 10% to about 20%, by weight of the detergent composition, of a plasticizer for the film which is glycerol;

from about 0.01% to about 5%, by weight of the detergent composition, of hydrogenated castor oil;

from about 10% to about 80%, by weight of the detergent composition, of surfactant; and less than about 25%, by weight of the detergent composition, of water wherein the viscosity of the liquid detergent composition at 21° C. and at a low shear rate of $0.5s^{-1}$ is greater than 3000 centipoises and wherein the liquid detergent composition further comprises from about 0.1% to about 6%, by weight of the detergent composition, of zwitterionic polyamine.

2. A water-soluble pouch containing liquid detergent composition according to claim 1, wherein the liquid detergent composition further comprises plasticizer selected from ethylene glycol, diethylene glycol and mixtures thereof.

3. A water-soluble pouch containing a liquid detergent composition according to claim 1, comprising from about 5 to about 15%, by weight of the detergent composition, of water.

* * * * *